US006112946A

United States Patent [19]

Bennett et al.

[11] Patent Number: 6,112,946

[45] Date of Patent: Sep. 5, 2000

[54] AUTOFILL SYSTEM FOR FROZEN BEVERAGES

[75] Inventors: Charles E. Bennett, Sacramento; Antonio J. Jepson, Dixon; Richard A. Martindale, Vacaville, all of Calif.

[73] Assignee: Automatic Bar Controls, Inc., Vacaville, Calif.

[21] Appl. No.: 09/396,018

[22] Filed: Sep. 15, 1999

Related U.S. Application Data

[60] Provisional application No. 60/116,326, Jan. 19, 1999.

[51] Int. Cl.[7] ..... B67D 7/00

[52] U.S. Cl. ..... 222/1; 222/64; 222/146.6

[58] Field of Search ..... 222/1, 64, 146.6

[56] References Cited

U.S. PATENT DOCUMENTS

| | | | |
|---|---|---|---|
| 4,252,139 | 2/1981 | Davis et al. | 222/64 X |
| 4,407,356 | 10/1983 | DeLau | 222/146.6 X |
| 4,651,538 | 3/1987 | Bull et al. | 222/146.6 X |
| 5,480,063 | 1/1996 | Keyes et al. | 222/64 |

*Primary Examiner*—Kevin Shaver
*Assistant Examiner*—Thach Bui
*Attorney, Agent, or Firm*—Townsend and Townsend and Crew LLP

[57] ABSTRACT

This invention provides a system and a method of economically and efficiently dispensing frozen beverages within a desired range of consistency in a continuous manner suitable for large-scale high-volume usage. A sensor is used to monitor the level of the beverage in a container for providing the frozen beverage. The beverage is cooled by a cooling device which has a cooling capacity. A flow regulating device is used to regulate the flow rate of the beverage to the container. A controller is coupled with the sensor and the flow regulating device to regulate the flow rate of the beverage in response to the monitored beverage level and the cooling capacity of the cooling device. When properly tuned to match the cooling capacity of the cooling device with the flow rate of the beverage into the container, the controller maintains the desired consistency of the frozen beverage, while automatically refilling the beverage container to within a desired range of levels.

20 Claims, 2 Drawing Sheets

AUTOFILL SYSTEM FOR FROZEN BEVERAGES

This application claims benefit to U.S. provisional application Ser. No. 60/116,326 filed Jan. 19, 1999.

BACKGROUND OF THE INVENTION

This invention relates generally to filling container for dispensing beverages and, more particularly, to a system for automatically filling containers for providing frozen beverages. Frozen beverage dispensing systems are common. For purposes of this discussion, the term "frozen beverage" is used to refer to a beverage that is at least partially frozen. Heretofore, when it was desired to provide a frozen beverage, the beverage was poured into a dispensing container and cooled using a refrigeration unit which maintains the frozen beverage in a desired consistency at a particular temperature. When it is necessary to refill the container, additional beverage is poured into the container and cooled for a period of time before dispensing can resume. Conventional systems for producing frozen beverages were labor-intensive and could not continuously provide frozen beverages. Thus, there is a need for a more efficient and inexpensive system for dispensing frozen beverages.

SUMMARY OF THE INVENTION

The present invention relates to an improved dispensing system for efficiently and economically delivering frozen beverages within a desired range of consistency in a continuous manner suitable for large-scale high-volume usage. The invention provides for automatically filling a container for providing frozen beverage to avoid the need to interrupt operation of the dispensing system for refilling and to eliminate down time. The level of the beverage in the container is monitored. A controller controls the flow of the beverage into the container in response to the monitored level of the beverage. To prevent flowing the beverage to the container at an unacceptably high rate that would ruin the consistency of the frozen beverage, the flow rate or fill rate is kept below a maximum allowable flow rate which is determined by the cooling or freezing capacity of the cooling unit used to freeze the beverage in the container as well as the ambient temperature. Empirical data are obtained to provide maximum allowable flow rates for different cooling capacity values and ambient temperatures. The system can be tuned based on the empirical data. The system, when properly tuned to match the freezing capacity with the fill rate, will maintain the desired consistency of frozen beverage, while automatically refilling the beverage container to within a desired range of levels.

In accordance with an embodiment of the present invention, a system for automatically filling a container for providing a beverage that is at least partially frozen comprises a delivery line coupled with the container for delivering a beverage to the container. A flow regulating device is coupled with the delivery line to regulate the flow rate of the beverage to the container. A cooling device is operatively coupled with the container for cooling the beverage in the container so that the beverage is at least partially frozen. The cooling device has a cooling capacity. A sensor is coupled with the container for sensing a level of the beverage in the container. A controller is coupled with the sensor for receiving a sensor signal indicating the level of the beverage in the container. The controller is coupled with the flow regulating device for controlling the flow regulating device to regulate the flow rate of the beverage delivered to the container in response to the sensor signal received from the sensor and the cooling capacity of the cooling device so as to maintain the at least partially frozen beverage in the container to within a desired range of consistency.

Another embodiment of the invention is a system for automatically filling a container for dispensing a beverage that is at least partially frozen. The system comprises means for delivering a beverage to the container, means for cooling the beverage in the container to at least partially freeze the beverage, the cooling means having a cooling capacity, and means for monitoring a level of the beverage in the container. A controller is coupled with the monitoring means for receiving a signal indicating the level of the beverage in the container. The controller is coupled with the delivering means for controlling the flow rate of the beverage delivered to the container in response to the cooling capacity of the cooling means and the signal of the monitoring means to automatically maintain the level of the beverage in the container to within a preset level range and to keep the at least partially frozen beverage in the container to within a desired range of consistency.

Yet another embodiment of the invention is a method of automatically filling a container for providing at least partially frozen beverage. The method comprises directing a flow of beverage to the container, and cooling the beverage in the container to at least partially freeze the beverage using a cooling device having a cooling capacity. The method further comprises sensing a level of the beverage in the container. The flow rate of the beverage is adjusted to the container to maintain the level of the beverage in the container to within a preset level range. The flow rate of the beverage to the container is kept below a maximum allowable flow rate which is determined by the cooling capacity of the cooling device to maintain the at least partially frozen beverage in the container to within a desired range of consistency.

BRIEF DESCRIPTION OF THE DRAWINGS

The specific embodiments of this invention, illustrating all their features, will now be discussed in detail. These embodiments depict the novel and nonobvious autofill system of this invention shown in the accompanying drawings, which are included for illustrative purposes only. These drawings include the following figures, with like numerals indicating like parts.

DESCRIPTION OF THE SPECIFIC EMBODIMENTS

Figure 1:
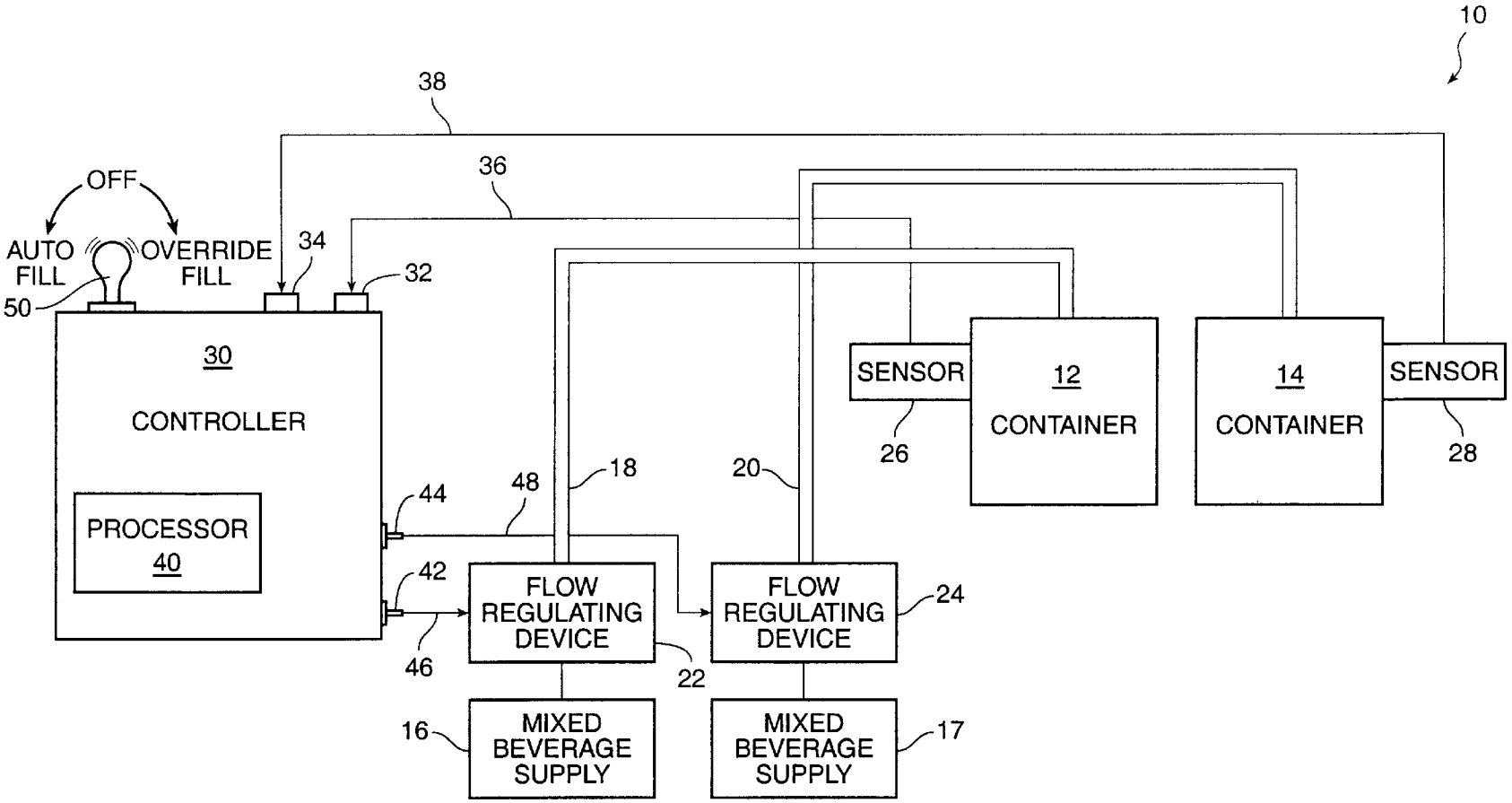
FIG. 1 is a block diagram schematically illustrating an autofill system in accordance with an embodiment of the present invention.

FIG. 1 schematically illustrates a system 10 for filling containers 12, 14 with beverages from sources or supplies 16, 17. The system can be used for filling fewer or more containers from more than one beverage source. The beverages are delivered to the containers 12, 14 via delivery lines 18, 20 using one or more pumps (not shown) which are disposed upstream or downstream of the beverage sources 16, 17. Flow regulating devices 22, 24 are desirably provided in the delivery lines 18, 20 for regulating the flow rate of the beverages. Examples of suitable flow regulating devices include valves, switches, solenoids, and the like. Sensors 26, 28 are provided for monitoring or sensing the level of beverages in the containers 12, 14. The beverage supplies 16, 17 typically provide mixed beverages and may include a brix-mixing manifold for mixing beverage concentrates and water (not shown).

The system 10 includes a controller 30 for controlling the flow of the beverages to the containers 12, 14. The controller 30 has two sensor input ports 32, 34 connected with the sensors 26, 28 via signal cables or lines 36, 38 for receiving sensor signals from the sensors 26, 28. A processor 40 such as a microprocessor in the controller 30 processes the beverage level data contained in the sensor signals. The controller 30 has two control output ports 42, 44 which are connected via control lines 46, 48 with the flow regulating devices 22, 24 for the two delivery lines 18, 20. The processor 40 controls operation of the flow regulating devices 22, 24 via the control lines 46, 48. The controller 30 includes a mode switch 50 having an OFF position, an AUTO FILL mode position, and an OVERRIDE FILL mode position. The controller 30 may comprise a personal computer or the like, and is connected to a power supply (not shown).

Figure 2:
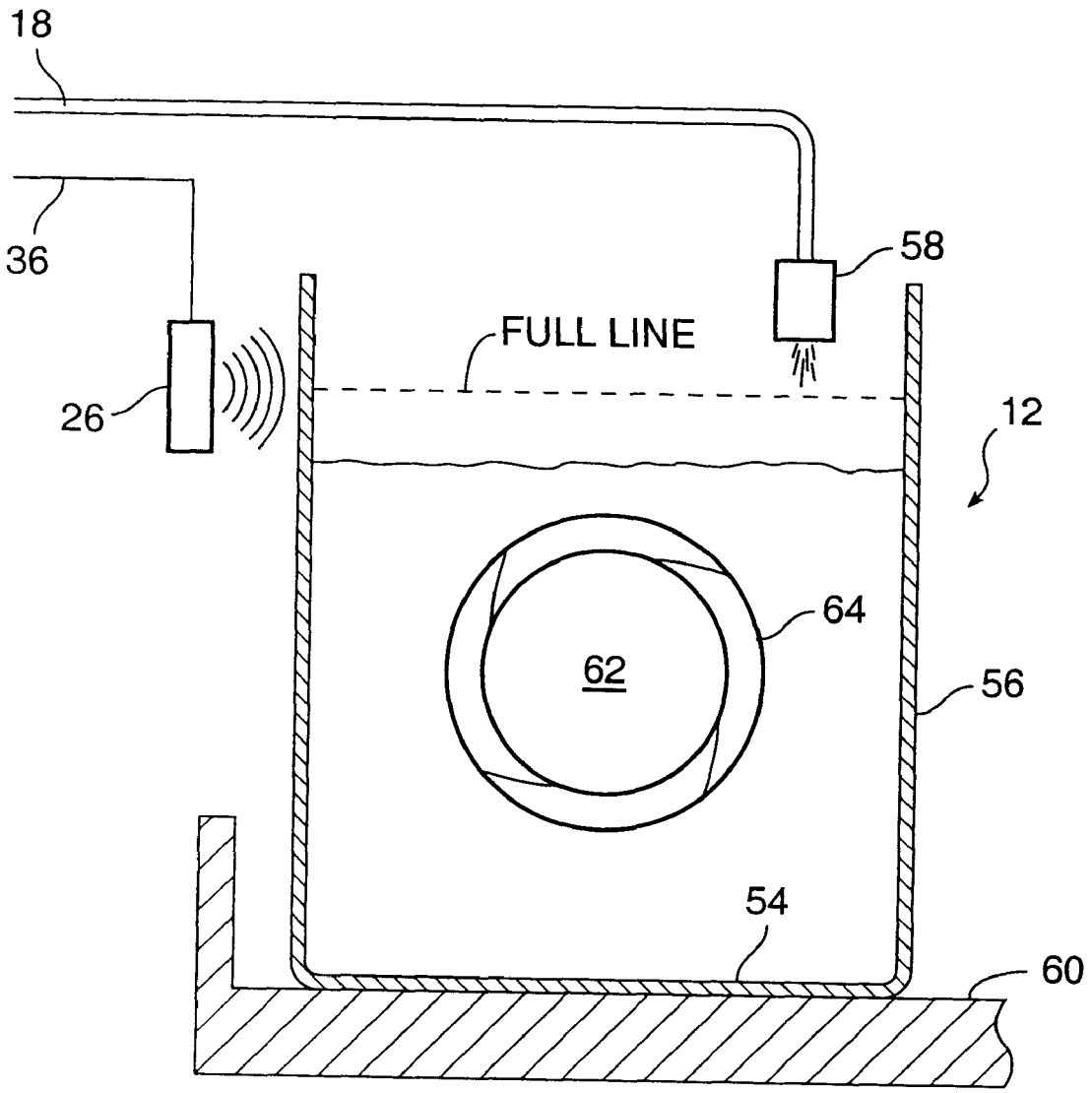
FIG. 2 is a sectional view of a container for providing at least partially frozen beverage in accordance with an embodiment of the present invention.

An exemplary embodiment of the container 12 is shown in FIG. 2. The container 14 may be identical to the container 12. The container 12 has a generally cylindrical shape with a bottom 54 and a side wall 56. The container 12 may be made of a variety of materials, including metals and plastics. One embodiment of the container 12 is made of a transparent plastic material. A filler spigot or fitting 58 is desirably connected with the container 12 to which the delivery line 18 is releasably coupled for discharging the beverage into the container 12. The filler spigot 58 positions the delivery line 18 for delivering the beverage during use, and allows the delivery line 18 to be conveniently disconnected for cleaning and maintenance. The container 12 has a cover (not shown) which encloses the container interior.

A cooling unit or device 60 cools the beverage in the container 12 to an at least partially frozen state. The cooling device 60 includes a heat transfer unit or drum 62 disposed in the container 12. The unit 62 has a generally circular shape, but may have other shapes. The heat transfer unit 62 has a flow of coolant or refrigerant therein which is chilled using any known refrigeration process known in the art (not shown). When the heat transfer unit 62 comes in contact with the beverage, heat is transferred from the beverage to the unit 62. In order to ensure uniformity and consistency of the beverage in the container 12 and to avoid buildup of frozen beverage on the external surface of the heat transfer unit 62, a stirring or agitation unit 64 is preferably provided to stir the beverage. The stirring unit 64 is desirably configured to contact at least a portion of the external surface of the heat transfer unit 62 to scrape off any buildup of frozen beverage to ensure efficient heat transfer operation between the unit 62 and the beverage. In this embodiment, the stirring unit 64 is a stirring spindle that rotates relative to the external surface of the heat transfer unit 62. A single cooling device 60 may be configured to accommodate multiple containers. An example of a cooling device 60 of this type is the ICE TWISTER, ICE DREAM 2, available from SPM Catering, s.r.l. of Spilamberto, Italy.

The sensor 26 is a level sensor which is coupled to the container 12. In this embodiment, the container 12 has a transparent side wall 56 and the sensor 26 is connected to the outside of the side wall 56. The sensor 26 in this embodiment is a proximity sensor which operates on electronic capacitance through the transparent side wall 56 of the container 12 for sensing the beverage level. An example of a suitable sensor is the Pepperl+Fuchs sensors. Of course, other types of sensors can be used. The external sensor of the type shown is advantageous because it can be easily connected to and disconnected from the container, and does not contaminate the interior of the container 12. Further, the sensor 26 is easily connected to the exterior of the container 12 using a suction cup (not shown) or the like which does not require complex mounting hardware and does not cause damage to the container 12. The sensor 26 is connected in the vicinity of a target full line of the container 12 at which the container 12 is considered full. The sensor 26 is typically centered with respect to the target full line. The sensor 26 may include an indicator light that comes on when the container 12 is full (not shown).

In operation, the mode switch 50 of the controller 30 is turned on and switched to the OVERRIDE FILL mode. In the OVERRIDE FILL mode, the controller 30 directs the flow regulating devices 22, 24 to flow the beverages to the container 12, 14 to fill the containers 12, 14. Typically, the mode switch 50 is switched from the OVERRIDE FILL mode to the OFF position when the beverages covers the stirring units 64, although the mode switch 50 may be switched off after the beverages substantially reach the full lines of the containers 12, 14. The cooling device 60 is turned on to cool the beverages to the desired temperature and consistency. The mode switch 50 is then set to the AUTO FILL mode.

In the AUTO FILL mode, the controller 30 controls operation of the flow regulating devices 22, 24 in response to the sensor signals received from the sensors 26, 28. In one embodiment, the controller 30 automatically directs the flow regulating devices 22, 24 to terminate the flow of the beverage to the containers 12, 14 when the sensor signals indicate that the levels of the beverage in the containers 12, 14 have reached preset maximum levels. The preset maximum levels may be identical to or slightly above the full lines of the containers 12, 14. The controller 30 automatically reactivates the flow regulating devices 22, 24 to resume the flow of the beverages to the containers 12, 14 when the sensor signals indicate that the levels of the beverages in the containers 12, 14 have fallen to or below preset minimum levels.

To prevent flowing the beverages to the containers 12, 14 at an unacceptably high rate that would ruin the consistency of the frozen beverages, the flow rates of the beverages are kept below maximum allowable flow rates. The maximum allowable flow rate for each container 12, 14 is determined by the cooling capacity of the cooling device 60 and the ambient temperature. Empirical data can be obtained by conducting experiments to obtain maximum allowable flow rates for different cooling capacity values and ambient temperatures, so that the frozen beverage stays within a desired range of consistency. The empirical data can then be used to tune the controller 30 for particular operating conditions. The system 10, when properly tuned to match the cooling capacity of the cooling device 60 and the maximum allowable flow rates, will maintain the desired consistency of frozen beverages, while automatically refilling the beverage containers 12, 14 to within a desired range of levels.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention as defined in the following claims are expressly intended to be embraced thereby.

What is claimed is:

1. A system for automatically filling a container for providing a beverage that is at least partially frozen, the system comprising:

a delivery line coupled with the container for delivering a beverage to the container;

a flow regulating device coupled with the delivery line to regulate the flow of the beverage to the container;

a cooling device operatively coupled with the container for cooling the beverage in the container so that the beverage is at least partially frozen, the cooling device being a power-driven cooling device having a cooling capacity;

a sensor coupled with the container for sensing a level of the beverage in the container; and a controller coupled with the sensor for receiving a sensor signal indicating the level of the beverage in the container, the controller coupled with the flow regulating device for automatically controlling the flow regulating device to regulate the flow rate of the beverage delivered to the container in response to the sensor signal received from the sensor and the cooling capacity of the cooling device so as to maintain the at least partially frozen beverage in the container to within a desired range of consistency.

2. The system of claim 1 wherein the container has a transparent wall and the sensor is coupled to an external surface of the transparent wall.

3. The system of claim 1 wherein the sensor is a proximity sensor which is disposed in the vicinity of a target full line of the container at which the container is full.

4. The system of claim 1 wherein the cooling device comprises a heat transfer unit disposed in the container, the heat transfer unit having a coolant flow therethrough for cooling the beverage in the container.

5. The system of claim 1 further comprising a stirring unit disposed in the container for stirring the beverage in the container to increase uniformity and consistency of the at least partially frozen beverage.

6. The system of claim 5 wherein the cooling device comprises a heat transfer unit disposed in the container for cooling the beverage in the container, and the stirring unit is configured to contact at least a portion of an external surface of the heat transfer unit to inhibit buildup of frozen beverage on the external surface of the heat transfer unit.

7. The system of claim 1 wherein the container has a filler spigot connected therewith and the delivery line is releasably coupled with the filler spigot for delivering the beverage to the container.

8. The system of claim 1 wherein the flow regulating device comprises a switch.

9. The system of claim 1 wherein the flow regulating device comprises a solenoid.

10. The system of claim 1 wherein the controller is configured to automatically direct the flow regulating device to terminate the flow of the beverage to the container when the sensor signal indicates that the level of the beverage in the container reaches a preset maximum level, and to reactivate the flow of the beverage to the container when the sensor signal indicates that the level of the beverage in the container falls to a preset minimum level.

11. The system of claim 1 wherein the controller is tuned to limit the flow rate of the beverage regulated by the flow regulating device for delivery to the container to a maximum allowable flow rate determined by the cooling capacity of the cooling device and ambient temperature to maintain the at least partially frozen beverage in the container to within the desired range of consistency.

12. The system of claim 1 wherein the controller includes a mode switch which has an override fill mode and an auto fill mode, the controller directing the flow regulating device to deliver the beverage to the container in the override fill mode, the controller controlling the flow regulating device to automatically maintain the level of the beverage in the container to within a preset level range in the auto fill mode.

13. A system for automatically filling a container for dispensing a beverage that is at least partially frozen, the system comprising:

means for delivering a beverage to the container;

means for cooling the beverage in the container to at least partially freeze the beverage, the cooling means having a cooling capacity;

means for monitoring a level of the beverage in the container; and a controller coupled with the monitoring means for receiving a signal indicating the level of the beverage in the container, the controller coupled with the delivering means for controlling the flow rate of the beverage delivered to the container in response to the cooling capacity of the cooling means and the signal of the monitoring means to automatically maintain the level of the beverage in the container to within a preset level range and to keep the at least partially frozen beverage in the container to within a desired range of consistency.

14. The system of claim 13 wherein the sensor is an electronic capacitance sensor.

15. The system of claim 13 wherein the controller is tuned to the cooling capacity of the cooling means so as to limit the flow rate of the beverage delivered to the container by the delivering means to a maximum allowable flow rate to keep the at least partially frozen beverage in the container to within a desired range of consistency.

16. A method of automatically filling a container for providing at least partially frozen beverage, comprising the steps of:

directing a flow of beverage to the container;

cooling the beverage in the container to at least partially freeze the beverage using a cooling device having a cooling capacity;

sensing a level of the beverage in the container; and adjusting a flow rate of the beverage to the container to maintain the level of the beverage in the container to within a preset level range, the flow rate of the beverage to the container being kept below a maximum allowable flow rate which is determined by the cooling capacity of the cooling device to maintain the at least partially freeze beverage in the container to within a desired range of consistency.

17. The method of claim 16 further comprising the step of agitating the beverage in the container to increase uniformity and consistency of the at least partially frozen beverage.

18. The method of claim 16 wherein the adjusting step comprises automatically terminating the flow of beverage to the container when the level of the beverage in the container reaches a preset maximum level and automatically reactivating the flow of the beverage to the container when the level of the beverage in the container falls to a preset minimum level.

19. The method of claim 16 further comprising the step of determining maximum allowable flow rates based on the cooling capacity of the cooling device and different ambient temperatures to maintain the at least partially frozen beverage in the container to within a desired range of consistency.

20. The method of claim 19 further comprising the steps of measuring the ambient temperature; and selecting a maximum allowable flow rate corresponding to the measured ambient temperature as provided in the determining step for use in adjusting the flow rate of the beverage to the container.

* * * * *